US009677289B2

(12) United States Patent
Simek

(10) Patent No.: US 9,677,289 B2
(45) Date of Patent: Jun. 13, 2017

(54) MUD PAN

(71) Applicant: Steve Simek, Cocoa, FL (US)

(72) Inventor: Steve Simek, Cocoa, FL (US)

( * ) Notice: Subject to any disclaimer, the term of this patent is extended or adjusted under 35 U.S.C. 154(b) by 0 days.

(21) Appl. No.: 14/591,024

(22) Filed: Jan. 7, 2015

(65) Prior Publication Data

US 2015/0197947 A1 Jul. 16, 2015

Related U.S. Application Data

(60) Provisional application No. 61/926,519, filed on Jan. 13, 2014.

(51) Int. Cl.
*E04F 21/02* (2006.01)
*B65D 25/28* (2006.01)

(52) U.S. Cl.
CPC ..... *E04F 21/02* (2013.01); *B65D 25/2808* (2013.01)

(58) Field of Classification Search
CPC . E04F 21/02; B65D 25/2808; B65D 25/2805; B65D 25/2802
USPC ..... 220/660, 755, 695, 696, 697, 752
See application file for complete search history.

(56) References Cited

U.S. PATENT DOCUMENTS 5,603,428 A * 2/1997 Breckwoldt ..... E04F 21/02 220/636
6,006,936 A * 12/1999 Przybylowicz ..... 220/23.8
6,398,066 B1 * 6/2002 Mullins ..... A47G 19/2211 220/731
6,454,124 B1 * 9/2002 Edwards et al. ..... 220/636
6,575,328 B1 * 6/2003 Foraker ..... 220/739
6,622,340 B2 * 9/2003 Rosa ..... B05C 17/0245 15/257.06
6,637,792 B1 10/2003 McCoy et al.
6,648,165 B1 11/2003 Accardo
D501,124 S * 1/2005 Brzoska ..... D8/14
6,923,485 B1 * 8/2005 Bauswell ..... 294/3.5
7,959,030 B2 * 6/2011 Bergman ..... B44D 3/126 220/570
2002/0182318 A1 12/2002 Kruskamp
2003/0015532 A1 * 1/2003 Rickman et al. ..... 220/212
2003/0034349 A1 * 2/2003 Frey ..... E04F 21/02 220/632
2006/0169705 A1 * 8/2006 Pool ..... 220/629
2006/0273086 A1 * 12/2006 Marino et al. ..... 220/62.1
2007/0029215 A1 * 2/2007 Martinez et al. ..... 206/223
2008/0000918 A1 * 1/2008 Bruno et al. ..... 220/695
(Continued)

*Primary Examiner* — Steven A. Reynolds
(74) *Attorney, Agent, or Firm* — Global Intellectual Property Agency, LLC; Daniel Boudwin

(57) ABSTRACT

An ergonomic mud pan having a base connected to upstanding sidewalls defining an interior volume, wherein the sidewalls extend from the base in an angular fashion forming a slightly flared open upper. The sidewalls include a first pair of sidewalls and a second pair of sidewalls, wherein the second pair of sidewalls provide a trapezoid shape in order to readily enable the user to place a drywall knife in the interior volume of the device in order to remove drywall mud therefrom. An ergonomic handle is provided that is disposed on one of the first pair of sidewalls, wherein the handle is concave in structure. The user can place one's palm against the exterior surface of the sidewalls, wherein the fingers rest against the base such that pressure is alleviated against the back of the user's hand to enable prolonged holding of the mud pan during completion of a task.

5 Claims, 2 Drawing Sheets

(56) References Cited

U.S. PATENT DOCUMENTS

| | | | | |
|---|---|---|---|---|
| 2008/0315600 | A1* | 12/2008 | Fischer | 294/3.5 |
| 2011/0290803 | A1 | 12/2011 | Kehres | |
| 2012/0067906 | A1* | 3/2012 | Szasz | 220/657 |
| 2013/0175281 | A1* | 7/2013 | Dattilo | 220/660 |

* cited by examiner

MUD PAN

CROSS REFERENCE TO RELATED APPLICATION

This application claims the benefit of U.S. Provisional Application No. 61/926,519 filed on Jan. 13, 2014. The above identified patent application is herein incorporated by reference in its entirety to provide continuity of disclosure.

BACKGROUND OF THE INVENTION

Field of the Invention

The present invention relates to mud pans for scooping drywall joint compound, or drywall mud, and the like. More specifically the invention relates to a drywall mud pan having an ergonomic handle that is concave in shape in order to alleviate pressure onto the back of the hand of the user. The mud pan provides a flared open upper in a preferred embodiment to further enable the user to scoop and apply drywall mud to a surface using a drywall mud knife.

Conventional mud pans involve the use of containers that do not include handles or structures adapted for the well-being of the muscles and joints of the human body. Mud pans are often used for prolonged periods of time and are held via in one's hand while being filled with drywall mud and the like causing pain and stress on the joints and muscles thereof. Such mud pans do not provide a handle and can be difficult to transport and carry and may require the use of both hands when performing a task. Other types of mud pans can include a means to hold and/or carry the mud pan, while still causing negative strain on the arm, hand and other areas of the body of the user.

Accordingly, the present invention relates to a new and improved ergonomic mud pan incorporating a base, sidewalls defining an interior volume and a slightly flared open upper, and an ergonomic handle disposed on a sidewall. The ergonomic handle is concave in structure in order to alleviate pressure on the back of the user's hand while carrying and transporting the mud pan. The flared open upper enables a drywall mud knife to readily fit therein, wherein the mud pan can be tilted such that the perimeter edge of the open upper can slide along a surface to scoop drywall mud into the interior volume of the mud pan.

Description of the Prior Art

Devices have been disclosed in the prior art that relate to mud pans. These include devices that have been patented and published in patent application publications. These devices generally relate to mud pans. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 6,923,485 to Bauswell describes an ergonomic container that includes a support for engaging the arm of the user having a handle on the lower end thereof and an interior volume in which concrete or dry wall material can be placed. The present invention however, provides a mud pan having an open upper and an interior volume, wherein the device includes an ergonomic handle having a concave shape.

U.S. Patent No. 2002/0182318 to Kruskamp discloses a hand-held adhesive trough that enables a user to comfortably hold the device via grip type of handle on the base thereof, and on which the user can wrap one's fingers. The device provides compartments in which inserts can be placed and removed as needed. Still, the present invention provides a mud pan having an ergonomic concaved handle, a base, sidewalls defining an interior volume and having an open upper, wherein the base can rest in the user's fingers.

U.S. Pat. No. 6,637,792 to McCoy allows for a mud pan support device having a flat bottom panel to which a mud pan can be magnetically attached to and removed from as desired. There can be a cylindrical handle that can be grasped by the user in order to hold the mud pan in an upright position. While this device may be helpful in the way of holding a mud pan thereon, it offers little utility for enabling a user to scoop of dry wall therein.

U.S. Pat. No. 6,648,165 to Accardo provides an ergonomic container having two receptacles adjacent to one another and forming one unitary body, wherein the device can be balanced on the forearm of the user in order to reduce movement of the wrist and alleviate stress thereto. The present invention however, provides an ergonomic handle having a concave, rounded structure in order to eliminate pressure applied to the user's hand when holding the device.

U.S. Patent No. 2011/0290803 to Kehres describes a mud pan for use in drywall finishing having a bottom wall, a mounting structure and a handle. The handle is removably connected to the base of the device. The present invention however, provides an ergonomic handle that is secured to a sidewall of the mud pan and that is concave in structure to reduce stress placed on the user's hand.

These prior art devices have several known drawbacks. The above discussed devices do not provide for a mud pan having a concave handle and an open upper having a flared structure, wherein at least one sidewall extends angularly from the base portion in order to enable the user to readily scoop and apply drywall mud to a surface. In light of the devices disclosed in the prior art, it is submitted that the present invention substantially diverges in design elements from the prior art and consequently it is clear that there is a need in the art for an improvement to existing mud pan devices. In this regard the instant invention substantially fulfills these needs.

SUMMARY OF THE INVENTION

In view of the foregoing disadvantages inherent in the known types of mud pans now present in the prior art, the present invention provides a new mud pan having an ergonomic handle, wherein the same can be utilized for providing convenience for the user when scooping dry wall mud and the like.

It is therefore an object of the present invention to provide a new and improved mud pan device that has all of the advantages of the prior art and none of the disadvantages.

It is another object of the present invention to provide a mud pan having an ergonomic handle on a sidewall thereof that is concave in shape.

Another object of the present invention is to provide a mud pan that can be utilized to scoop drywall mud, concrete mixture and the like.

Yet another object of the present invention is to provide a mud pan that can stand in an upright position when placed on a planar surface.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
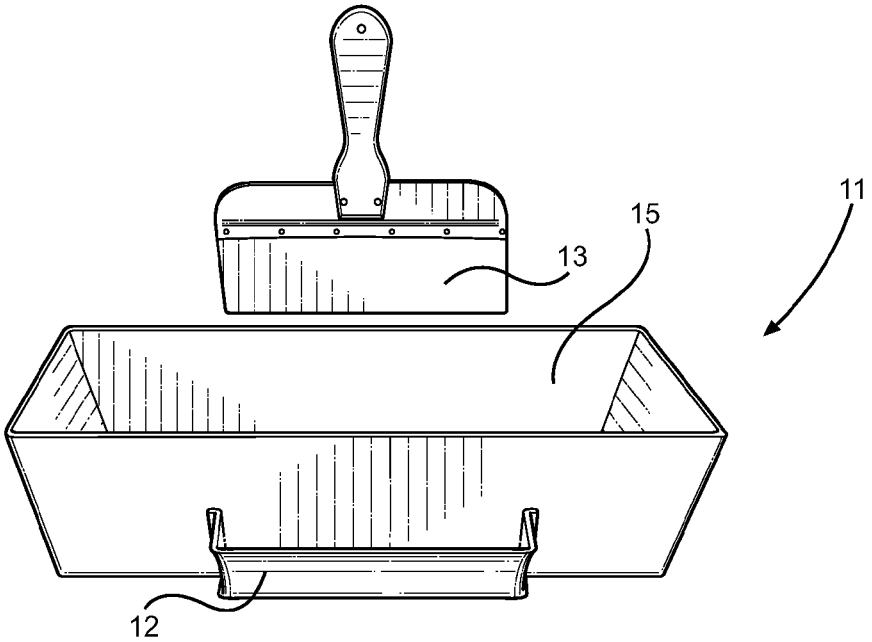
FIG. 1 shows a top view of the mud pan having a base and sidewalls defining an interior volume and having an open upper, wherein an ergonomic concave handle is connected to one sidewall.

Reference is made herein to the attached drawings. Like reference numerals are used throughout the drawings to depict like or similar elements of the mud pan. For the purposes of presenting a brief and clear description of the present invention, the preferred embodiment will be discussed as used for scooping and holding concrete mixture, drywall mud and the like therein. The figures are intended for representative purposes only and should not be considered to be limiting in any respect.

Referring now to FIG. 1, there is shown an overhead view of the mud pan 11 having a base 16 and sidewalls defining an interior volume 15 and having a slightly flared open upper, wherein a handle 12 is connected to one sidewall. The flared open upper provides a perimeter edge. The base 16 is preferably rectangular in shape. The sidewalls of the mud pan 11 extend upward from the base 16 and include a pair of first sidewalls and a pair of second sidewalls, wherein the first sidewalls oppose another and the second sidewalls oppose one another. The base 16 of the mud pan 11 provides a first side, a second side and an outer perimeter edge, wherein the outer perimeter edge forms right angles at the corners thereof. The bottom edges of both the first sidewalls and the second sidewalls are connect to the second side of the outer perimeter edge of base, wherein the side edge of the first sidewalls and the second side walls are connected to one another, respectively forming one unitary body with an interior volume and an open upper.

The side edges of the second sidewalls are angled such that the second sidewalls comprise a trapezoid shape, and similarly the side edges of the first sidewalls are angled such that the first sidewalls comprise a trapezoid shape. The mud pan 11 comprises a slightly flared open upper, wherein the sidewalls extend upward and outward from said base 16 at an angle, such that the opening of the mud pan 11 is wider than the base 16 of the mud pan. The slightly flared open upper of the mud pan 11 enables a user to more readily scrape and scoop concrete mixture or dry wall mud from a planar surface, wherein the top edge of one of the first sidewalls can contact the surface on which dry wall mud is placed thereon and can slide across the surface along the length thereof to lift dry wall mud therefrom. Further, the flared open upper is such that the user can manually place the mud pan 11 in an inverted position and drag the perimeter edge of the flared open upper along a surface having drywall mud in order to scrape the drywall mud into the mud pan 11 and the like.

The handle 12 of the mud pan 11 is disposed on one of the pair of first side walls near the bottom thereof. The handle 12 provides a first end and a second end, wherein the first and second ends are connected to the first side of one of the pair of first side walls and is thus integral therewith forming one unitary body. The ends of the handle 12 extend perpendicularly therefrom and bend into a U-shaped structure having a top portion, wherein the top portion runs parallel with the first side wall to which it is connected. The top portion of the handle 12 provides a concave structure, wherein the first side thereof dips inward along the length thereof forming a rounded structure on the interior side thereof. The side portions provide a slightly concave structure, however the sides do not form a rounded structure on the second side thereof and are substantially planar as such.

Figure 2:
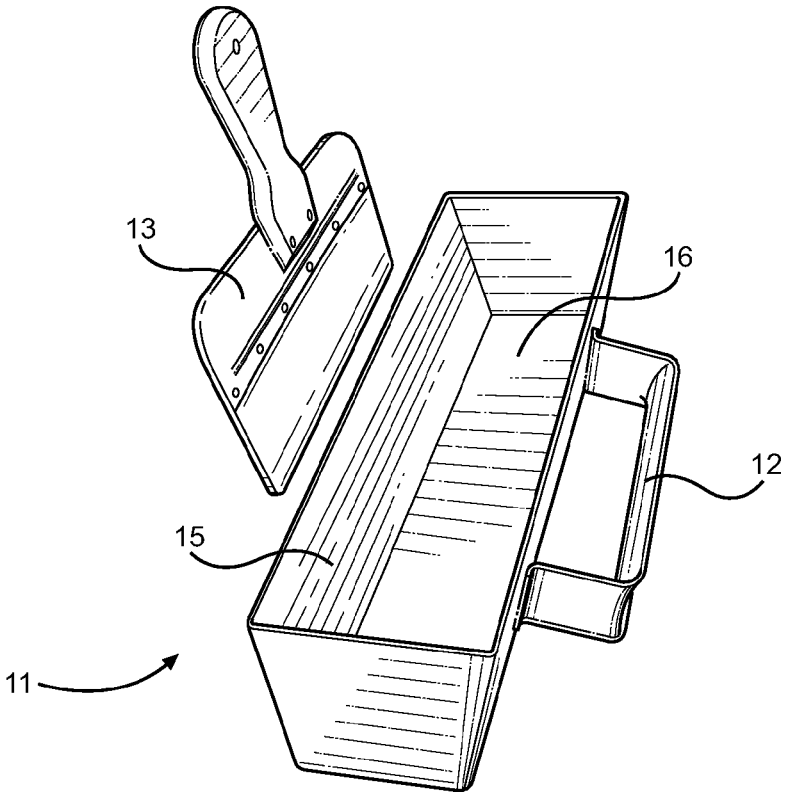
FIG. 2 shows a perspective view of the mud pan having a base and sidewalls defining an interior volume and having an open upper, wherein the sidewalls provide angled edges and the ergonomic concave handle forms a rounded structure.

FIG. 2 shows a perspective view of the mud pan having a base and sidewalls defining an interior volume and having an open upper, wherein the sidewalls provide angled edges and the ergonomic concave handle forms a rounded structure. The angled side edges of the pair of second side walls are such that the bottom of the pair of second side walls form a tapered structure. The handle 12 is attached to one of the pair of the first side walls in such a way that an opening is created between first side wall and the handle 12. The user can place one's palm against the surface of one of the first side walls having the handle 12 disposed thereon, such that the back of the user's hand contacts the grip the mud pan 11, wherein the second side of the handle 12 contacts the back of the user's hand and the back of the user's hand can rest against the first side of the handle 12.

The user can place a drywall mud knife 13 having a blade, wherein the blade can lay flush against the first sidewall located opposite the first sidewall having the handle 12 disposed thereon, wherein the drywall within the interior volume of the invention in order to scrape up drywall mud therefrom. In operation, the user can hold the mud pan 11 with one hand via the handle 12 and use the opposite hand to scoop the drywall mud therefrom. The mud pan 11 is further adapted to stand upright when placed on a flat surface such as the ground or cement. The mud pan 11 can be made from plastic, stainless steel, rubber, wood, iron, metal, aluminum and/or other suitable materials.

Figure 3:
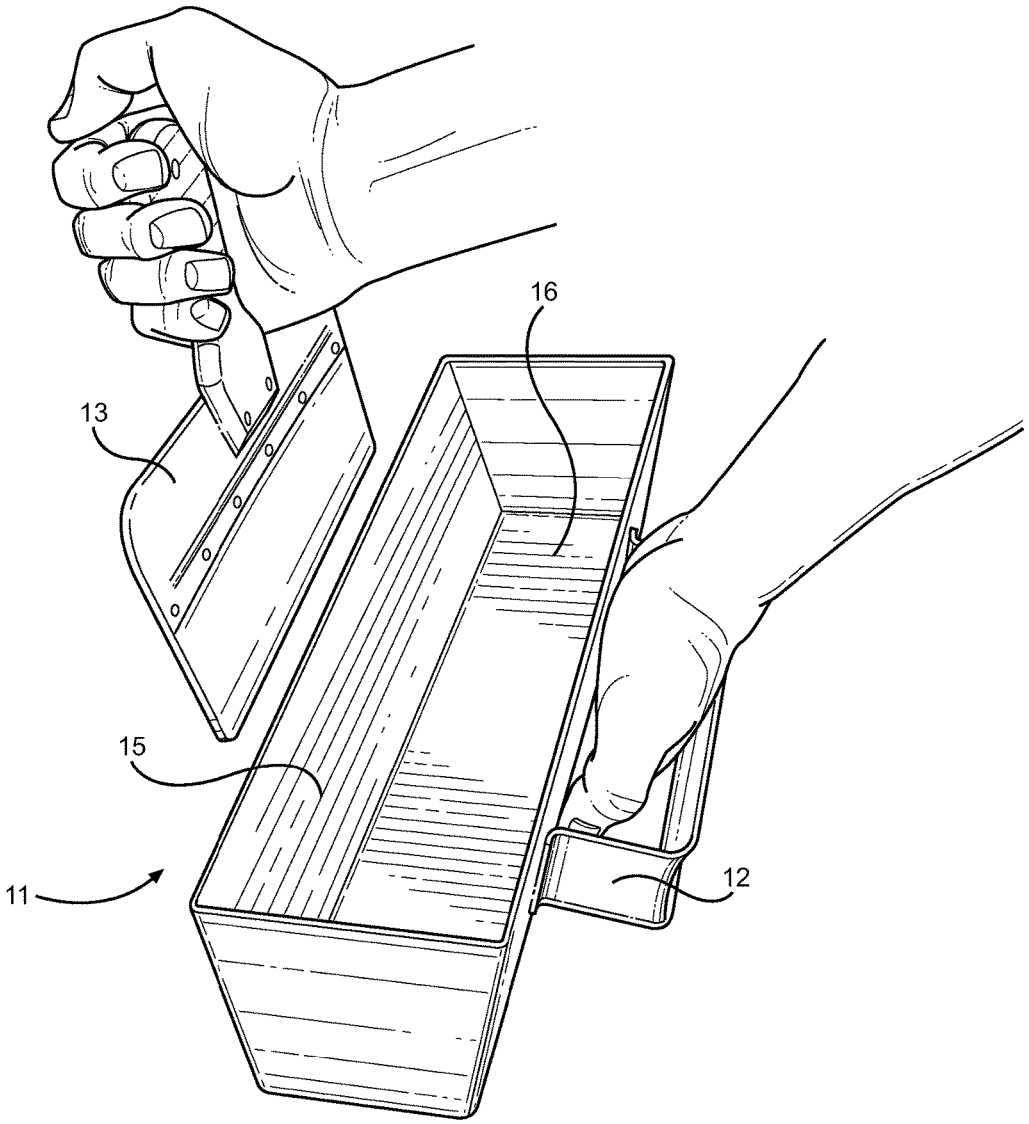
FIG. 3 shows a view of the manner in which the mud pan is held by the user, wherein the user's fingers can be inserted therethrough and one sidewall can rest within the user's palm, while one's fingers remain in contact against the base thereof.

FIG. 3 shows a view of the manner in which the mud pan 11 is held by the user, wherein the user's fingers can be inserted therethrough and one sidewall can rest within the user's palm, while one's fingers remain in contact against the base thereof. The mud pan 11 provides a flared open upper in a preferred embodiment, however the open upper need not be flared and can be vertical or perpendicular to the base, rather than disposed at an angle relative to the base. The user can place the blade of a drywall knife 13 into the open upper and against one of the first sidewalls 15 that is opposite the handle 12 such that it is flush against the interior surface of one of the first sidewalls 15 and can reach into the crevices formed via the base 16 and the pair of first sidewalls and the pair of second sidewalls to which the user can further drag the blade of the drywall knife 13 along the second side of the base 16 to lift drywall mud therefrom.

In an alternate embodiment, the mud pan 11 comprises a base and a first pair of sidewalls and a second pair of sidewalls. The second pair of sidewalls extend upward and outward from the base at an angle, other than 90 degrees. The first pair of sidewalls includes one wall disposed perpendicularly to the base 16, and a second wall that extends from the base 16 in an upward and angled orientation. In such an embodiment, the handle 12 is disposed on the sidewall that is perpendicular to the base 16. In alternate embodiments, the second sidewalls are perpendicular to the base 16, and one of said first sidewalls is perpendicular to the base 16 while a second first sidewall is angled.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A container, comprising:

a base, a longitudinal sidewall, and a lateral sidewall defining an interior volume including an open upper portion;

a handle including a curved body having a first end, a second end, and an apex portion, the apex portion having an outer surface and an inner surface, wherein the first end and the second end are attached to an exterior surface of a first lateral sidewall;

wherein the handle and the exterior surface of the first lateral sidewall define an opening therebetween, the opening sized to receive a hand therethrough;

wherein the outer surface of the apex portion is oriented toward the exterior surface of the first lateral sidewall;

wherein the outer surface of the apex portion of the handle is configured to contact a back of the hand when a palm of the hand is resting against the exterior surface of the first lateral sidewall.

2. The container of claim 1, wherein the base, the lateral sidewall, the longitudinal sidewall, and the handle form a unitary structure.

3. The container of claim 1, wherein the base, the lateral sidewall, and the longitudinal sidewall form a trapezoidal prism shape.

4. The container of claim 1, wherein the longitudinal sidewall extends upward from the base to form a flared open upper portion.

5. The container of claim 1, wherein the lateral sidewall extends perpendicularly from the base.

* * * * *